United States Patent [19]

Higuchi et al.

[11] Patent Number: 4,534,710

[45] Date of Patent: Aug. 13, 1985

[54] SWASH-PLATE-TYPE COMPRESSOR HAVING SUCTION AND DISCHARGE DAMPING CHAMBERS

[75] Inventors: Takeshi Higuchi, Toyota; Yoshio Itakura; Hidekazu Iwamori, both of Kariya, all of Japan

[73] Assignee: Kabushiki Kaisha Toyoda Jidoshokki Seisakusho, Aichi, Japan

[21] Appl. No.: 583,101

[22] Filed: Feb. 23, 1984

[30] Foreign Application Priority Data

Mar. 2, 1983 [JP] Japan ..... 58-29993[U]

[51] Int. Cl.[3] ..... F04B 1/16; F04B 21/00

[52] U.S. Cl. ..... 417/269; 417/312

[58] Field of Search ..... 417/269, 270, 312, 313

[56] References Cited

U.S. PATENT DOCUMENTS

| | | | |
|---|---|---|---|
| 3,577,891 | 5/1971 | Nemoto et al. | 417/312 X |
| 3,785,751 | 1/1974 | Nemoto et al. | 417/312 X |
| 3,801,227 | 4/1974 | Nakayama | 417/269 |
| 3,876,339 | 4/1975 | Gannaway | 417/312 |
| 4,221,544 | 9/1980 | Ohta | 417/313 X |
| 4,274,813 | 6/1981 | Kishi et al. | 417/312 X |
| 4,351,227 | 9/1982 | Copp, Jr. et al. | 417/269 X |
| 4,403,921 | 9/1983 | Kato et al. | 417/296 |
| 4,407,638 | 10/1983 | Sasaya et al. | 417/312 X |
| 4,413,955 | 11/1983 | Kato et al. | 417/270 |
| 4,431,378 | 2/1984 | Hattori et al. | 417/269 |
| 4,432,702 | 2/1984 | Honzawa et al. | 417/269 |

*Primary Examiner*—William L. Freeh
*Assistant Examiner*—Paul F. Neils
*Attorney, Agent, or Firm*—Burgess, Ryan & Wayne

[57] ABSTRACT

A multi-cylinder swash-plate-type compressor having a combined cylinder block closed on both axial ends by front and rear housings and provided therein with a reciprocative piston mechanism for sucking, compressing, and discharging a fluid, such as a refrigerant gas. The combined cylinder block is provided with a mounting bracket on the outer circumference thereof and suction and discharge ports formed in the outer circumference at positions adjacent to the mounting bracket. The compressor further has damping chambers arranged adjacent to the suction and discharge ports for suppressing pulsation in suction and discharge pressures of the refrigerant gas during the operation of the compressor. The damping chambers have considerable volumes and cross-sectional area.

8 Claims, 3 Drawing Figures

SWASH-PLATE-TYPE COMPRESSOR HAVING SUCTION AND DISCHARGE DAMPING CHAMBERS

BACKGROUND OF THE INVENTION

1. Field of the Invention

The present invention relates to a swash-plate-type compressor, preferably adapted for use in automobile air-conditioning systems.

2. Description of the Prior Art

U.S. Pat. No. 4,403,921 of Kimio Kato et al discloses a typical swash-plate-type refrigerant-gas compressor for use in automobile air-conditioning systems. The conventional compressor has a pair of axially aligned and combined cylinder blocks in which a multi-cylinder compressing system operated by a single rotary swash plate is contained. The combined cylinder blocks are held between front and rear housings in which suction and discharge chambers are arranged.

Refrigerant gas returning from the air-conditioning system is sucked into and compressed by the compressor due to the reciprocating motion of pistons in the cylinder bores of the combined cylinder block. That is, the returning gas is initially sucked from a suction pipe into isometric inlet passageways of a suction flange. The refrigerant gas is then introduced via suction ports of the cylinder blocks into a swash-plate chamber. Subsequently, the refrigerant gas is passed through suction passageways communicated with the swash-plate chamber until it reaches the suction chambers of the front and rear housings. The refrigerant gas in the suction chambers is then sucked into the cylinder bores so as to undergo compression by the pistons.

During the above-mentioned sucking of the refrigerant gas, the pulsation in the suction pressure due to the reciprocating motion of the pistons is damped when the refrigerant gas is let into the swash-plate chamber and the suction chambers, both of which have rather large volumes, from the preceding narrow passageways.

The refrigerant gas, when compressed, is discharged from the cylinder bores into the discharge chambers. The compressed refrigerant gas is then passed through discharge passageways and ports of the combined cylinder blocks. Subsequently, the compressed refrigerant gas is passed through the passageways of a discharge flange, which are isometric with the above-mentioned discharge ports, and is further sent via a discharge pipe into the air-conditioning system.

The pulsation in the discharge pressure due to the reciprocating motion of the pistons is damped in the discharge chambers. However, more complete damping of the pulsation in the suction and discharge pressures is desired in order to prevent noise.

BRIEF SUMMARY OF THE INVENTION

An object of the present invention is to provide an improvement of the structure of a swash-plate type compressor whereby more complete damping of pulsation in suction and discharge pressures is achieved.

Another object of the present invention is to provide a multi-cylinder swash-plate type compressor which has an improved damping means for more positively suppressing pulsation in suction and discharge pressures.

A further object of the present invention is to provide a swash-plate type compressor of quiet operation.

In accordance with the present invention, there is provided a multi-cylinder swash-plate type compressor provided with: cylinder block means having an outer circumference thereof on which mounting bracket means and suction and discharge pipes are held and also having therein a swash-plate-operated reciprocative piston mechanism for sucking, compressing, and discharging a gas, such as a refrigerant gas; housing means arranged so as to close the two axial ends of the cylinder block means and having therein suction and discharge chambers communicatable with the reciprocative piston mechanism; and suction and discharge ports formed in a part of the outer circumference of the cylinder block means and communicating with the suction and discharge chambers and with the suction and discharge pipes, respectively. The compressor is characterized by comprising damping means arranged between the suction and discharge ports of the cylinder block means and the suction and discharge pipes for suppressing pulsation in suction and discharge pressures of the gas.

Preferably, the damping means comprises extension means arranged on the outer circumference of the cylinder block means and cooperating with the mounting bracket so as to define suction and discharge damping chambers having considerable volumes and cross-sectional areas larger than those of the suction and discharge pipes, respectively.

BRIEF DESCRIPTION OF THE DRAWING

The present invention will be made more apparent from the ensuing description of an embodiment with reference to the accompanying drawings, wherein.

DESCRIPTION OF THE PREFERRED EMBODIMENT

Figure 1:
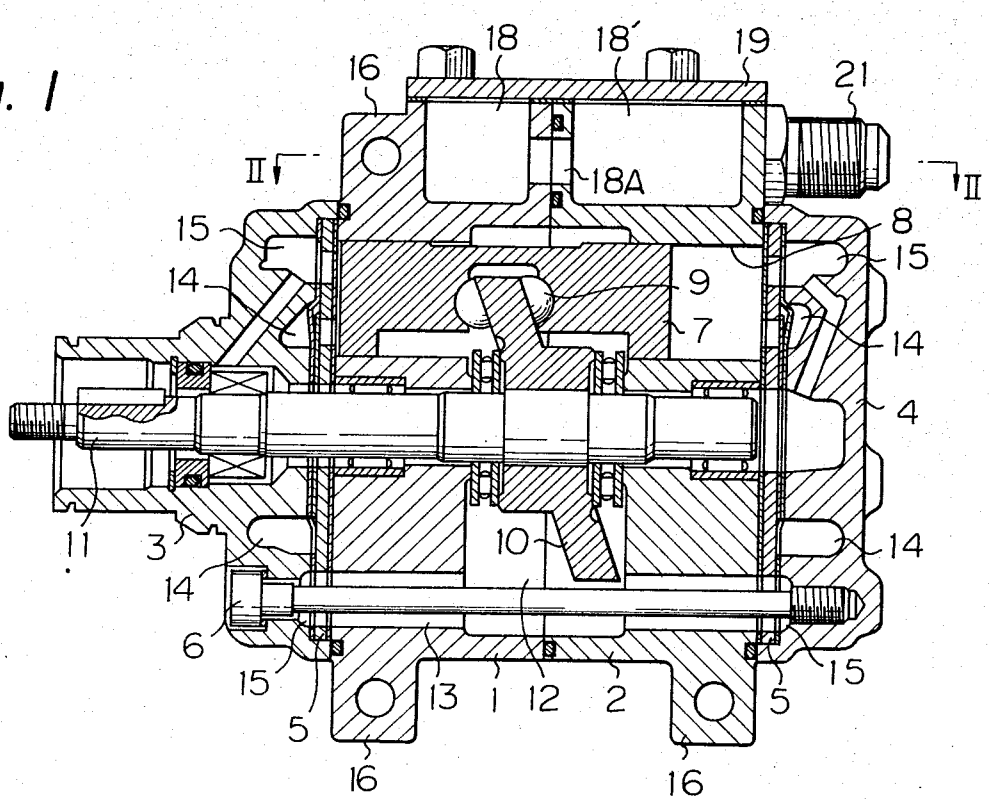
FIG. 1 is a longitudinal cross-sectional view of a multi-cylinder swash-plate-type compressor according to an embodiment of the present invention.
Figure 2:
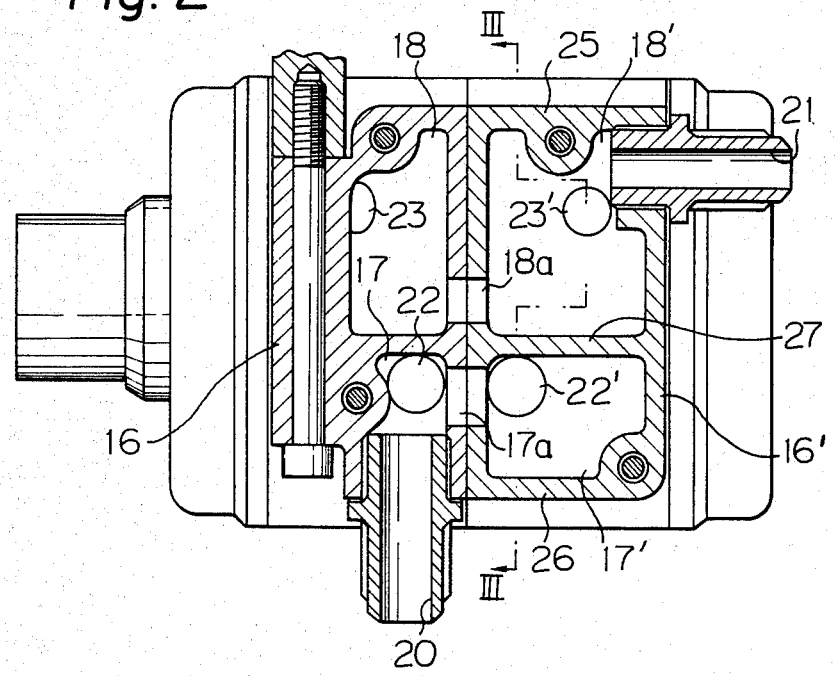
FIG. 2 is a cross-sectional view taken along the line II—II of FIG. 1.
Figure 3:
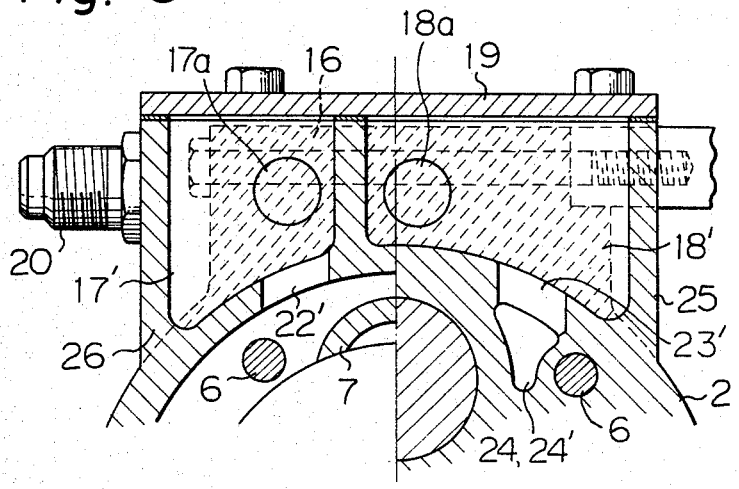
FIG. 3 is a partial cross-sectional view taken along the line III—III fo FIG. 2.

FIGS. 1 to 3 show an embodiment of the present invention, which is an improvement over the compressor of the type disclosed in the above-mentioned prior U.S. patent.

Referring to FIGS. 1 through 3, the multi-cylinder swash-plate-type compressor has a front cylinder block 1 and a rear cylinder block 2 combined with one another in axial alignment. Appropriate sealing members or gaskets are arranged between the two cylinder blocks 1 and 2, as shown in FIG. 1. Front and rear ends of the combined cylinder blocks are fluid-tightly closed by a front housing 3 and a rear housing 4, respectively. Valve plates 5 are arranged between the front housing 3 and the front end of the combined cylinder block and between the rear housing 4 and the rear end of the combined cylinder block. All the above-mentioned elements are axially tightly combined together by an appropriate number of screw bolts 6.

The combined cylinder blocks 1 and 2 are provided with an appropriate number of axially extending cylinder bores 8 arranged in parallel with one another. Within the cylinder bores 8 are disposed a corresponding number of double-headed pistons 7 operated by a swash plate 10 via half-sphere ball bearings 9. The swash plate 10 per se is fixed to a drive shaft 11 and is rotated through a swash-plate chamber 12 arranged in the combined portion of the front and rear cylinder blocks 1 and 2. The combined cylinder blocks 1 and 2 have formed therein suction passageways 13, which are also used for inserting therein the above-mentioned screw bolts 6, and discharge passageways 24 and 24' (FIG. 3). These suction and discharge passageways 13 and 24 are arranged between two adjacent cylinder bores 8.

Each of the front and rear housings 3 and 4 is formed with an inner discharge chamber 14 and an outer suction chamber 15 arranged to be separate from and concentric with one another. The discharge chambers 14 of the front and rear housings 3 and 4 are respectively in communication with the cylinder bores 8 and with the discharge passageways 24 and 24'. The suction chambers 15 of the front and rear housings 3 and 4 are respectively in communication with the cylinder bores 8 and the suction passageways 13.

The suction passageways 13 are in communication with suction ports 22 and 22', which are formed in a part of the outer wall of the combined front and rear cylinder blocks 1 and 2 as shown in FIG. 3. The discharge passageways 24 and 24' respectively communicate with discharge ports 23 and 23', which are formed in another part of the outer wall of the combined cylinder blocks 1 and 2. It should be noted that the suction ports 22 and 22' and the discharge ports 23 and 23' are all located adjacent to one or the other of upper and lower mounting brackets 16, which are used for mounting the compressor on, for example, a section of an automobile engine compartment. In the embodiment shown, the suction and discharge ports are located adjacent to the upper mounting bracket 16, which is also used together with upward extensions 16', 25 and 26 for defining a pair of suction damping chambers 17 and 17' and a pair of discharge damping chambers 18 and 18'. An upward wall 27 is arranged for separating the former damping chambers and the latter damping chambers. A covering 19 is arranged for fluid-tightly closing these chambers 17, 17', 18 and 18'. The suction damping chambers 17 and 17' are connected with one another via a communication port 17*a* and communicated with suction ports 22 and 22', as best shown in FIG. 2. Similarly, the discharge damping chambers 18 and 18' are connected with one another via a communicate port 18*a* and are communicate with discharge ports 23 and 23'.

A suction pipe 20 for introducing the refrigerant gas returning from the exterior air-conditioning system into the compressor is threadedly engaged in the upward extension 26, so that the refrigerant gas is allowed to flow into the suction damping chambers 17 and 17'.

A discharge pipe 21 for delivering the refrigerant gas after compression into the exterior air-conditioning system is threadedly engaged in the mounting bracket 16, so that the compressed refrigerant gas is delivered from the discharge damping chambers 18 and 18'. At this stage, it will be understood from the illustration of FIG. 3 that the axially projecting area of the front mounting bracket 16 on a plane perpendicular to the axis of the combined cylinder blocks 1 and 2 (i.e., the area hatched by broken lines) is almost equivalent to the axially projecting maximum area of the suction and discharge damping chambers 17' and 18' on the same plane (i.e., the area enclosed by extensions 25, 26, the cover 19, and the outer surface of the cylinder block 2). This means that the suction and discharge damping chambers 17, 17', 18 and 18' are defined by the positive use of space extending above the outer surface of the combined cylinder blocks 1 and 2 and not intended to effectively be used in the prior art compressor.

With the above-described structure of the swash-plate-type compressor, the operations of the compressor, i.e., sucking, compressing, and discharging of the refrigerant gas, are conducted by the rotation of the drive shaft 11. The drive shaft 11 is rotated from the outside, for example by, an automobile engine. The refrigerant gas sucked from the air-conditioning system by the suction pipe 20 goes through the suction damping chambers 17 and 17', the suction ports 22 and 22', the swash-plate chamber 12, the suction passageways 13, and the suction chambers 15 into the cylinder bores 8, in which the sucked refrigerant gas is subjected to compression by the pistons 7. The pulsation in the suction pressure of the refrigerant gas is damped or suppressed by the suction damping chambers 17 and 17', which have a large volume and a large cross-sectional area compared with the cross-sectional area of the suction pipe 20. The pulsation can also be suppressed by the swash-plate chamber 12.

The refrigerant gas compressed in the cylinder bores 8 goes through the discharge chamber 14, the discharge passageways 24, 24', the discharge ports 23 and 23', and the discharge damping chambers 18 and 18' into the discharge pipe 21, which delivers the compressed refrigerant gas to the air-conditioning system. The pulsation in the discharge pressure of the compressed refrigerant gas is suppressed by the discharge chamber 14 and the discharge damping chambers 18 and 18', which have a considerably large volume and a cross-sectional area larger than those of the discharge ports 23, 23'.

From the foregoing description, it will be understood that since the multi-cylinder swash-plate-type compressor of the present invention is provided with damping means for positively suppressing pulsation in suction and discharge pressures of the refrigerant gas during reciprocating movement of the pistons, noise is appreciably reduced. As a result, a swash-plate-type compressor of quiet operation is obtained.

It should be understood that a person skilled in the art will be readily able, without departing from the scope and spirit of the present invention, to make alternations such that the suction and discharge pipes are both arranged in parallel with or perpendicularly to the axis of the drive shaft.

We claim:

1. A multi-cylinder swash-plate-type compressor provided with axially extending cylinder block means having a generally circular outer circumference thereof from which mounting bracket means outwardly extend and have a length substantially equal to an outermost diameter of the compressor, and suction and discharge pipes held on the circular outer circumference of the cylinder block means and also having therein a swash-plate-operated reciprocative piston mechanism for sucking, compressing, and discharging a gas, housing means arranged so as to close axial ends of the cylinder block means and having therein suction and discharge chambers in communication with the reciprocative piston mechanism, and suction and discharge ports formed in a part of the outer circumference of the cylinder block means in communication with the suction and discharge chambers and with the suction and discharge pipes, wherein an improvement comprises damping means arranged between said suction and discharge ports of said cylinder block means and said suction and discharge pipes for suppressing pulsation in suction and discharge pressure of said gas, said damping means comprising extension means including a plurality of walls extending outward from said circular outer circumference of said cylinder block means and two of said walls being spaced apart a length substantially equal to the length of said mounting bracket means and said extension means cooperating with said mounting bracket means so as to define suction and discharge damping chambers having considerable volumes and cross-sectional areas larger than those of said suction and discharge pipes, respectively.

2. A compressor according to claim 1, wherein said suction and discharge damping chambers are separated from one another by a wall extending from said outer circumferences of said cylinder block means.

3. A compressor according to claim 1, wherein said suction and discharge damping chambers have respective bottoms formed by said part of the outer circumference of said cylinder block means, whereby said suction and discharge ports open in said suction and discharge damping chambers, respectively.

4. A compressor according to claim 1, wherein said suction and discharge damping chambers are formed so that an axially projecting area of said suction and discharge damping chambers on a plane vertical to an axis of said cylinder block means is substantially equal to an axially projecting area of said mounting bracket means on the same plane.

5. A compressor according to claim 1, wherein said suction and discharge pipes are held by said extension means.

6. A multi-cylinder compressor adapted for use in compressing a refrigerant gas of an air-conditioning system comprising:

axial cylinder block means having therein a swash-plate-operated reciprocative piston mechanism for sucking, compressing, and discharging said refrigerant gas;

a drive shaft rotatably arranged in said cylinder block means and holding thereon a swash plate;

housing means having therein a discharge chamber into which the refrigerant gas is discharged from said reciprocative piston mechanism and a suction chamber from which the refrigerant gas is sucked into said reciprocative piston mechanism;

suction and discharge ports formed in a section of an outer circumference of said cylinder block means, said suction and discharge ports fluidly communicating with said suction and discharge chambers of said housing means, respectively;

bracket means extending outward from said cylinder block means and having a length substantially equal to an outermost diameter of said compressor and arranged adjacent to said section of the outer circumference for mounting said compressor on an exterior position;

extension means including a plurality of walls extending outward from said outer circumference of said cylinder block means and two of said walls being spaced apart a length substantially equal to the length of said bracket means, said extension means cooperating with said bracket means so as to define two separated damping chambers, one for suppressing pulsation in suction pressure of said refrigerant gas and the other for suppressing pulsation in discharge pressure of said refrigerant gas, said one damping chamber for suppressing pulsation in suction pressure communicating with said suction port, said other damping chamber for suppressing pulsation in discharge pressure communicating with said discharge port; and suction and discharge pipes connecting said one and other damping chambers to said air-conditioning systems, respectively.

7. A compressor according to claim 6, wherein said suction and discharge pipes are held by said extension means.

8. A compressor according to claim 6, wherein said two damping chambers are formed so as to occupy a substantially rectangular space extending above said outer circumference of said cylinder block, said rectangular space having an axially projecting area on a plane perpendicular to an axis of said cylinder block, which area is substantially equal to an axially projecting area of said bracket means on said plane.

* * * * *